United States Patent [19]

Nagel et al.

[11] 4,420,975

[45] Dec. 20, 1983

[54] SYSTEM AND METHOD FOR DETERMINING THE RELATIVE PERMEABILITY OF AN EARTH FORMATION SURROUNDING A WELLBORE

[75] Inventors: Walter A. Nagel; David J. Walsh, both of Englewood, Colo.

[73] Assignee: Marathon Oil Company, Findlay, Ohio

[21] Appl. No.: 497,396

[22] Filed: May 23, 1983

Related U.S. Application Data

[63] Continuation-in-part of Ser. No. 279,094, Jun. 30, 1981, abandoned.

[51] Int. Cl.[3] ..... E21B 49/00

[52] U.S. Cl. ..... 73/155

[58] Field of Search ..... 73/155; 166/250; 250/256, 259, 260

[56] References Cited

U.S. PATENT DOCUMENTS

| | | | |
|---|---|---|---|
| 2,463,230 | 8/1949 | Dodson | 166/254 |
| 3,158,023 | 11/1964 | Brillant | 73/155 |
| 3,306,102 | 2/1967 | Lebourg | 73/155 |
| 3,550,445 | 12/1970 | Kiel | 73/155 |
| 3,559,476 | 2/1971 | Kuo et al. | 73/155 |
| 3,604,256 | 9/1971 | Prats | 73/155 |
| 3,636,762 | 1/1972 | Kuo et al. | 73/155 |
| 3,871,218 | 3/1975 | Louis | 73/155 |
| 4,349,737 | 9/1982 | Smith et al. | 250/259 |

*Primary Examiner*—Jerry W. Myracle

*Attorney, Agent, or Firm*—Jack L. Hummel; Rodney F. Brown

[57] ABSTRACT

A method for determining the relative permeability of an earth formation surrounding a wellbore having a longitudinal axis comprising the steps of injecting a fluid into the wellbore such that the fluid invades the earth formation, measuring at different points in time a quantity that varies in response to the radius from the wellbore axis of the fluid invasion into the earth formation, determining in response to said quantity measurements the radius from the wellbore axis of the fluid invasion into the earth formation, and determining in response to said radii determinations the relative permeability of the earth formation. A system for performing the method is also disclosed.

13 Claims, 7 Drawing Figures

$R_{xo}$
$R_t$
Resistivity
D
wellbore
wall
$D_i$
Diameter $R_{xo}$
$R_t$
Resistivity
D
wellbore
wall
$D_i$
$D_j$
Diameter

SYSTEM AND METHOD FOR DETERMINING THE RELATIVE PERMEABILITY OF AN EARTH FORMATION SURROUNDING A WELLBORE

CROSS-REFERENCE TO RELATED APPLICATIONS

This application is a continuation-in-part of our copending U.S. patent application Ser. No. 279,094, filed June 30, 1981, now abandoned.

TECHNICAL FIELD

The present invention relates to a system and a method for determining the relative permeability of an earth formation surrounding a wellbore.

BACKGROUND ART

The main physical characteristics needed to evaluate the degree to which a subterranean earth formation will produce a desired liquid such as water or oil are its porosity, liquid saturation, permeable bed thickness, and permeability. Permeability is a measure of the ease with which a formation permits a fluid of given viscosity to flow therethrough. To be permeable, a formation must have interconnected porosity (pores, vugs, capillaries, or fractures). Porosity which is not interconnected fails to contribute to formation permeability. The permeability of a given kind of earth formation to the flow of any homogeneous fluid is constant with time provided the fluid does not interact with the rock or other material comprising the formation.

Because of the importance of the permeability characteristic of a subterranean earth formation, several techniques have been used to measure the permeability of such formations, especially those surrounding wellbores. In one common procedure, as the wellbore is drilled, core samples of the formations are extracted to the earth's surface and then are transported to the laboratory for permeability analysis. Commonly, during such analysis the sample is placed in a tight-fitting container, and the flow rate through the sample of a fluid having a known viscosity and under a known pressure is measured. Laboratory analysis of core samples is time consuming, costly and cumbersome. Moreover, the samples are sometimes altered or damaged during extraction, transport or preparation for analysis, which introduces error in the analysis.

A Spontaneous-Potential ("SP") technique has been used to detect the location and thickness of relatively permeable earth formations. The SP technique involves a recording versus wellbore depth of the difference between the potential of a movable electrode in the wellbore and the fixed potential of a surface electrode. Variances or deflections of the SP recording curve result from electric currents flowing in the mud in the wellbore which are caused by electromotive forces in the earth formations, which forces are of electrochemical and electrokinetic origins. The SP technique detects primarily the boundaries of relatively permeable earth formations, and there is no direct relationship between the value of permeability and the magnitude of SP recording curve deflections. Moreover, the SP technique is extremely adversely affected by a variety of common wellbore and earth formation conditions such as are described in chapter two of the 1972 edition of Schlumberger Limited's "Log Interpretation Volume I—Principles."

Microresistivity devices are used to measure the resistivity of flushed earth formations and to delineate permeable formations by detecting the presence of mud cake along the wellbore wall. However, such measurements generally cannot provide accurate inferences of the formation permeability.

Many other logging techniques such as induction logging and neutron logging have been used to detect a variety of subterranean earth formation characteristics, but none has been used to determine the permeability or relative permeability of such formation.

A patentability search was conducted for the present invention, and the following patents were uncovered:

| U.S. Pat. No. | Inventor | Issue Date |
|---|---|---|
| 3,158,023 | Brillant | November 24, 1964 |
| 3,463,230 | Dodson | August 26, 1969 |
| 3,550,445 | Kiel | December 29, 1970 |
| 3,559,476 | Chiang-Hai Kuo et al. | February 2, 1971 |
| 3,636,762 | Kuo et al. | January 25, 1972 |
| 3,604,256 | Prats | September 14, 1971 |
| 3,871,218 | Louis | March 18, 1975 |

U.S. Pat. No. 3,158,023 estimates the permeability of ground around a borehole by measuring the rate at which water must be pumped from the borehole in order to maintain a predetermined lowering of the water level therein.

U.S. Pat. No. 3,463,230 disclosed a method of performing a relative permeability survey of the earth surrounding an oil well which includes plugging an increment of the earth by the introduction of floatable particles within the well and then making an injection test of the unplugged portion.

U.S. Pat. No. 3,550,445 discloses a method for testing wells for the existence of permeability damage to an earth formation.

U.S. Pat. No. 3,559,476 teaches a method for measuring the reservoir property of a porous earth formation surrounding a well by establishing a pulsating flow of fluid through the well adjacent to the porous earth formation into and out of the formation at rates that vary with time in accordance with a predetermined periodic function. The variations with time of the pressure in the well are measured and the phase shift and amplitude of the pressure variations with time relative to the variations with time of the rates of the pulsating flow of fluid are determined.

U.S. Pat. No. 3,636,762 relates to a method of measuring various reservoir properties of wells such as the skin factor and the permeability thickness product, which method comprises the steps of rapidly increasing the rate of fluid injection into a porous earth formation penetrated by a well, maintaining the fluid injection rate constant at a high rate, and recording the variation with time of the fluid injection pressure.

U.S. Pat. No. 3,604,256 relates to a method for measuring the average vertical permeability of a subterranean earth formation near a wellbore comprising the steps of sealing off the wellbore, perforating the wellbore at two vertically spaced locations, sealing the wellbore between the perforations, injecting fluid at a substantially constant rate through one of the perforations, and measuring the pressure response in the wellbore at the other perforation.

U.S. Pat. No. 3,871,218 discloses a method of determining the permeability characteristics of a medium surrounding a borehole comprising the steps of dividing the borehole longitudinally into three adjacent cavities, producing a flow of liquid in each cavity and in the corresponding regions of the medium, measuring the flow rate of liquid flowing in the intermediate cavity, and measuring the liquid pressure in the intermediate cavity and in the corresponding region of the medium at known distances from the borehole axis, and determining the permeability characteristics from the flow rate and the liquid pressure measurements.

DISCLOSURE OF THE INVENTION

Prior art methods of determining the permeability or relative permeability of an earth formation surrounding a wellbore have not utilized information relating to the radius from the wellbore axis of a fluid that has invaded the earth formation. According to the present invention, the relative permeability of an earth formation may be determined by injecting a fluid into the wellbore such that it invades the earth formation, measuring at different points in time a quantity that varies in response to the radius from the wellbore axis of the fluid invasion, determining in response to the quantity measurements the radius of fluid invasion at different points in time, and determining in response to the radii determinations the relative permeability of the formation. The quantity measurements can be made by a wide variety of available logging tools that have heretofore been used for purposes other than determining the relative permeability of earth formations in response to a determination of fluid invasion radii. As such, the present invention permits existing logging tools to provide valuable information concerning the permeability of an earth formation. Since the logging tools can be simultaneously used for their previous functions as well as for determining relative permeability, the present invention may be utilized without significant additional cost or time.

BRIEF DESCRIPTION OF THE DRAWINGS

The details of the present invention are described with reference to the accompanying drawings, wherein.

BEST MODE FOR CARRYING OUT THE INVENTION

Figure 1:
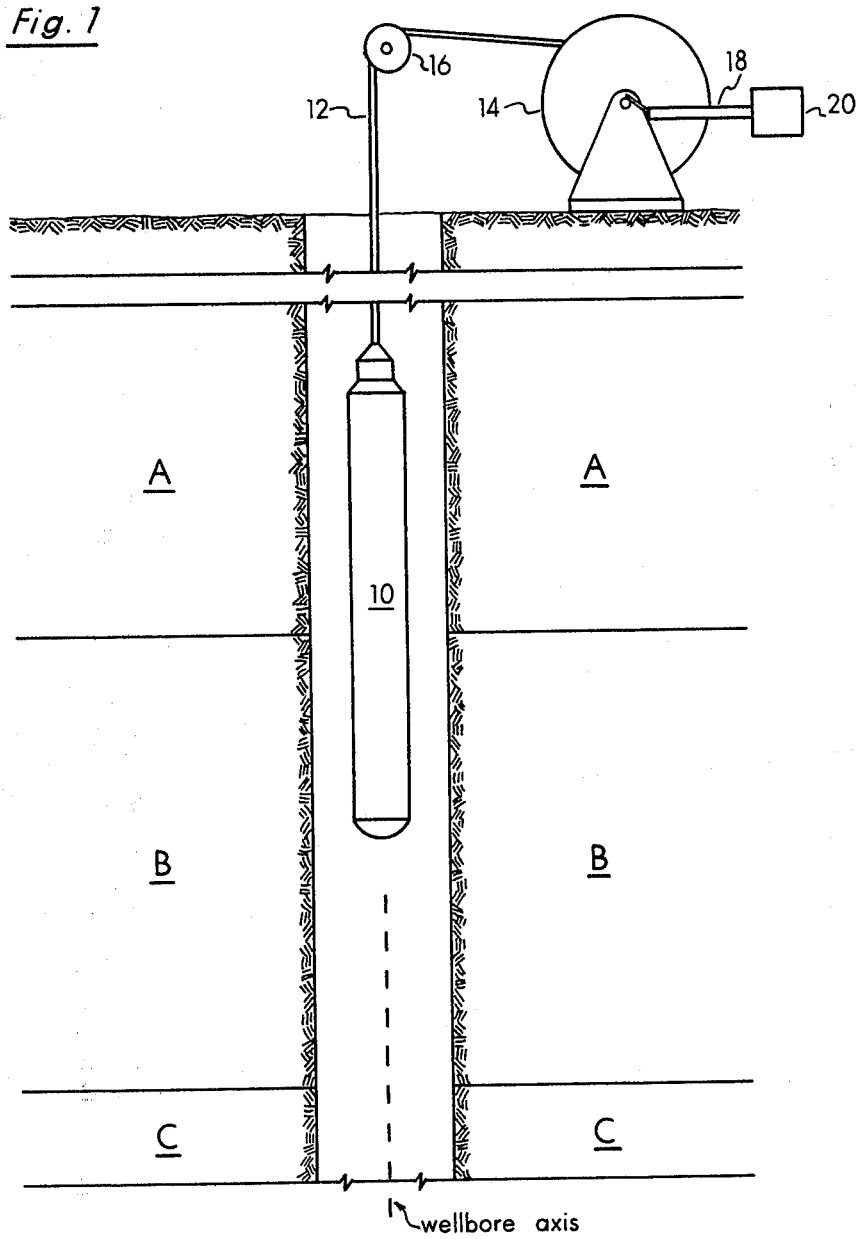
FIG. 1 is an illustration of a wellbore having a logging device lowered therein.

FIG. 1 illustrates an apparatus for carrying out the present invention. The apparatus includes an elongated housing 10 containing one or more logging instruments. The housing 10 is suspended from a logging cable 12 which is wound on a reel drum 14 and which extends over a sheave 16 in a known manner so as to be suitably positioned in the wellbore. It is to be understood that the usual wellhead equipment, such as lubricators, may also be utilized, but that such have been eliminated from the drawings as they have no bearing on the present invention. The electrical leads within the logging cable 12 are connected to electrical leads within an electrical circuit 18 in the usual manner. The latter leads are further connected to suitable computing, recording or display apparatus 20 at the earth's surface.

The housing 10 is moved vertically along the wellbore and the logging instruments contained therein monitor characteristics of the earth surrounding the wellbore or of the wellbore itself.

In accordance with the present invention, a fluid with properties that contrast from the natural formation fluid, is injected into the wellbore such that it invades the earth surrounding the wellbore, and the logging instruments measure or monitor a quantity that varies in response to the radius from the wellbore axis of the fluid invasion into the earth formation. As will become apparent, the present invention works equally well when the direction of natural formation fluid flow is toward the wellbore, displacing a previously-invaded fluid, and it is intended that any recitation herein of fluid invasion into the earth and away from the wellbore is the equivalent of fluid movement from the earth toward the wellbore.

Figure 2:
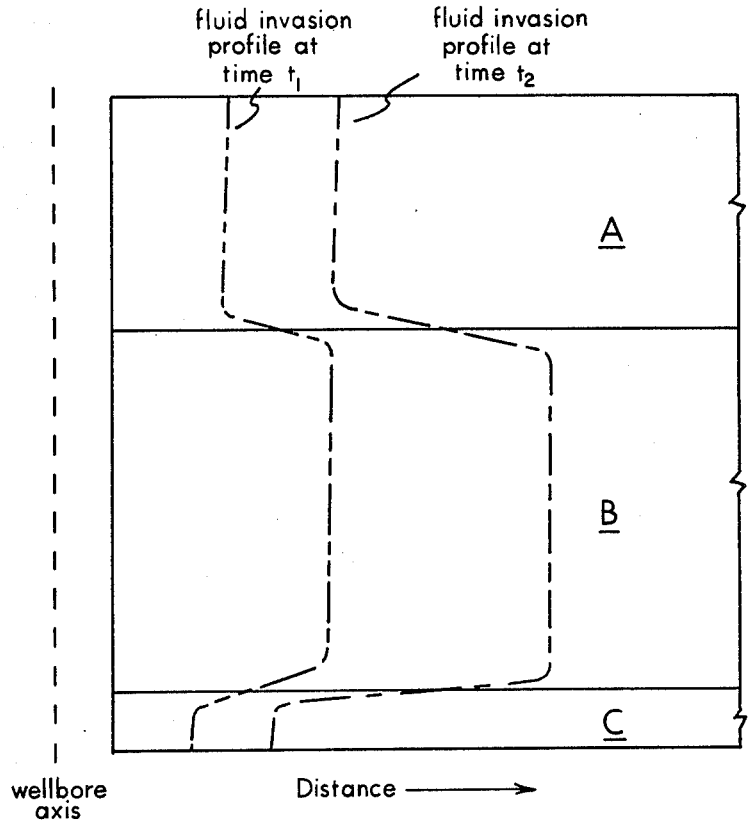
FIG. 2 is an illustration of possible input profiles of a fluid injected into a wellbore shown in FIG. 1 at two times after injection.

FIG. 2 is an illustration of possible input profiles of a fluid injected into the wellbore shown in FIG. 1 at two different times after injection. Earth formation B is more permeable than formation A, and formation A is more permeable than formation C.

The relative permeability of the earth formation may be expressed as a function of the relative change in the radius of fluid invasion over a given time. Such expression may be derived as follows. Consider the following flow conditions in a wellbore injected with a fluid:

$q$ = volumetric flow rate,
$r_o$ = wellbore radius,
$r_{i1}$ = radius of invaded zone at time $t_1$,
$r_{i2}$ = radius of invaded zone at time $t_2$,
$p$ = fluid pressure,
$A$ = surface area of wellbore layer of thickness h,
$\phi$ = porosity of the earth formation surrounding the wellbore,
$\mu$ = fluid viscosity
$\kappa$ = permeability of the earth formation surrounding the wellbore
$D_o$ = wellbore diameter.

The fluid flow away from the wellbore may be described by Darcy's equation:

$$\frac{dp}{dr} = C\frac{\mu q}{\kappa A} \tag{1}$$

where C is a constant. For steady-state, single phase flow conditions, it is assumed that (dp/dr) and $\mu$ are constant, whereby $$\kappa = \frac{C'}{A} q \tag{2}$$

where C' is a constant. Since $$A = \pi D_o h \tag{3}$$

we may write $\kappa$ as $$\kappa = \frac{C'}{D_o h} q \tag{4}$$

where C'' is a constant. However, q, the volumetric flow rate, equals the change of fluid volume per change of time, or $$q = \frac{\phi\pi h(r_{i2}^2 - r_{i1}^2)}{t_2 - t_1} \quad (5)$$

which may be written in terms of the fluid invasion diameters $$q = \frac{\phi\pi h}{4} \frac{D_{i2}^2 - D_{i1}^2}{t_2 - t_1} \quad (6)$$

Thus, the permeability of the earth formation may be written $$\kappa = \frac{C''\phi}{D_o} \frac{D_{i2}^2 - D_{i1}^2}{t_2 - t_1} \quad (7)$$

where C''' is a constant. Consequently, the relative permeability between two earth formations A and B or the like as measured for a given time interval is $$\frac{\kappa_A}{\kappa_B} = \left\{\frac{\phi}{D_o}\right\}_A \left\{\frac{D_o}{\phi}\right\}_B \frac{\{D_{i2}^2 - D_{i1}^2\}_A}{\{D_{i2}^2 - D_{i1}^2\}_B} \quad (8)$$

The porosity, $\phi$, and the wellbore diameter, $D_o$, may be readily and relatively accurately obtained from porosity and caliper logs, respectively. Therefore, to calculate relative permeability, only the diameters of invasion at two points in time need be obtained.

The invasion diameters may be determined through the use of conventional logging instruments that measure quantities that vary in response to the diameter of fluid invasion. Such determination will be described with respect to two kinds of such instruments, one of which measures formation resistivity and the other of which measures the decay time of thermal neutrons which result from high-energy neutrons injected into the formation.

The invasion diameter of a fluid may be determined from equations particularly corresponding to logging instruments measuring formation resistivity. For illustration, four such equations and instruments will be presented.

The resistivity measured by a particular instrument manufactured by Schlumberger Well Services, a proximity log PL, is defined:

$$R_{PL} = J(D_{LL})R_{xo} + \{1 - J(D_{LL})\}R_t \quad (9)$$

and a particular Schlumberger laterolog 8:

$$R_{LL8} = I(D_{LL})R_{xo} + \{1 - I(D_{LL})\}R_t \quad (10)$$

and a particular Schlumberger dual spacing medium induction device ILm:

$$\frac{1}{R_{ILm}} = \frac{g(D_{IL})}{R_{xo}} + \frac{\{1 - g(D_{IL})\}}{R_t} \quad (11)$$

and a particular Schlumberger deep induction device, ILd (6FF40):

$$\frac{1}{R_{ILd}} = \frac{G(D_{IL})}{R_{xo}} + \frac{\{1 - G(D_{IL})\}}{R_t} \quad (12)$$

Figure 5:
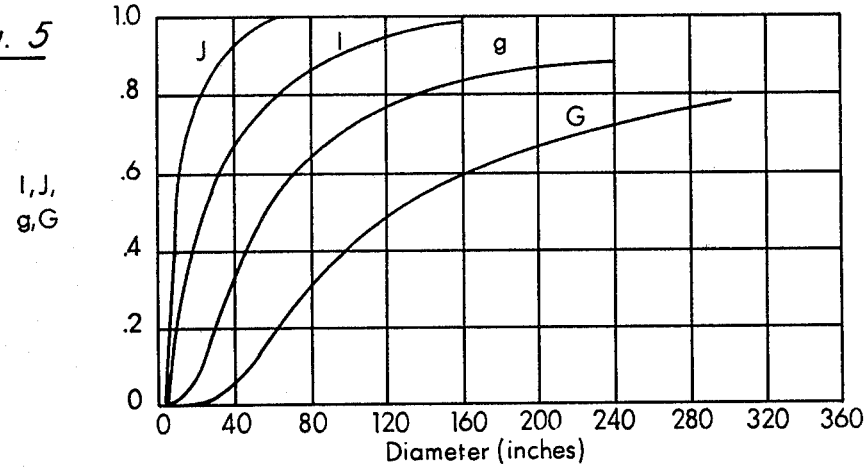
FIG. 5 is a plot of radial geometric factors for several particular logging tools.

In these four equations, $R_{xo}$ and $R_t$ are the resistivities of the invaded and virgin regions of the formation, respectively. The terms on the lefthand side of the equations are the actual quantities measured by each particular tool. The J, I, g and G functions are radial geometric factors for the associated tools, and are plotted versus the invasion diameter perceived by each tool in FIG. 5. The equations and the plots have been known in the art (See Moran et al., "A Progress Report on Machine Interpretation of Log Wells" SPWLA 3rd Annual Logging Symposium, May 1962), however, they have never been used heretofore to estimate relative permeability of a formation.

Figure 3:
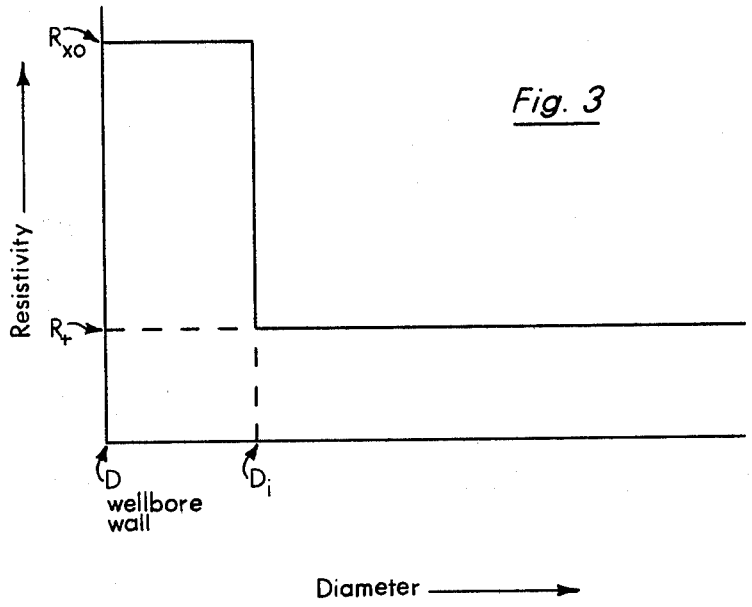
FIG. 3 is a resistivity step-profile.
Figure 4:
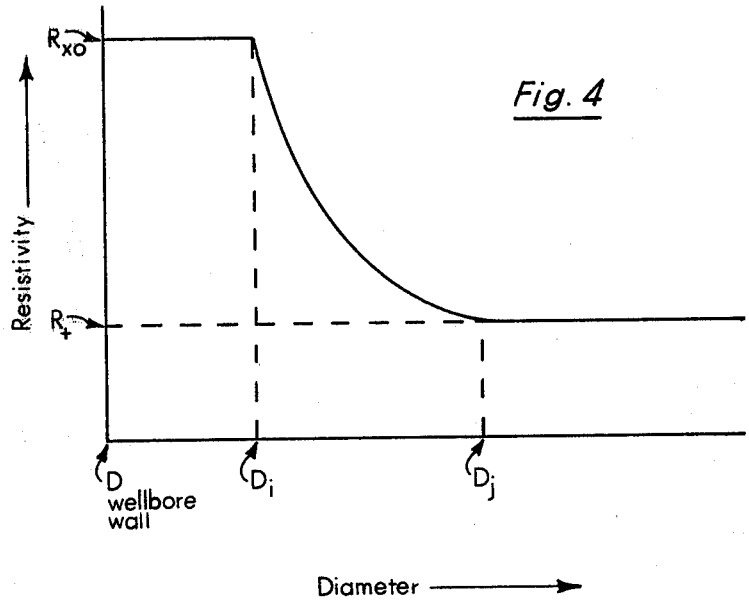
FIG. 4 is a resistivity profile with a transition zone.

The terms $D_{IL}$ and $D_{LL}$ are the "apparent" invasion diameters as sensed by the tools. When the fluid invasion has a step profile as shown in FIG. 3, $D_{LL} = D_{IL} = D$; however, when the fluid invasion has a transition profile, which might be caused by intermixing of the injected fluid with a fluid previously existing in the formation, such as shown in FIG. 4, then $D_{LL} \approx D_i$ and $D_{IL} \approx (D_i + D_j)/2$. The transition profile probably more frequently occurs. The method of the present invention for these logging tools can be used with either the step profile or the transition profile, however, when assuming the existence of a transition profile, it is important to use only those tools measuring a quantity responsive to $D_{LL}$ or only those tools measuring a quantity responsive to $D_{IL}$, and not to use the two kinds of tools together. In other words, it is important for the tools to sense the same apparent diameter of fluid invasion.

In the above equations relating to resistivity measured by the logging tools, there are three unknowns: $R_{xo}$, $R_t$ and D. The radial geometric functions J, I, g and G have a defined relation to D and are therefore not truly unknowns. To determine the permeability of the formation, we need to know the invasion diameter at two points of time, $D_{i1}$ and $D_{i2}$. Consequently, if each of two tools takes a resistivity measurement at the same two points in time, four equations in four unknowns will result, and $D_{i1}$ and $D_{i2}$ can be solved for. If each of the two tools takes a resistivity measurement of a different formation at the same two points in time (or over the same length of time), the relative permeabilities of the two formations may be determined (knowing the porosity and wellbore diameter at each measurement).

Figure 6:
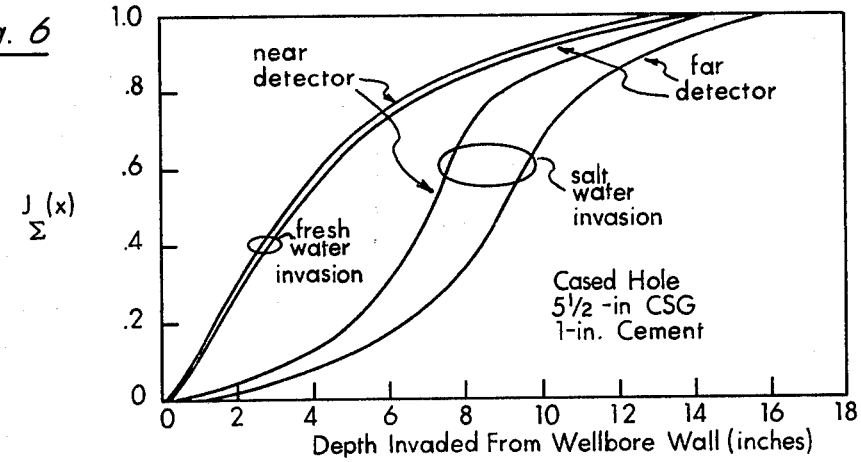
FIG. 6 is a plot of a geometric factor for a thermal neutron decay time log in a cased wellbore.
Figure 7:
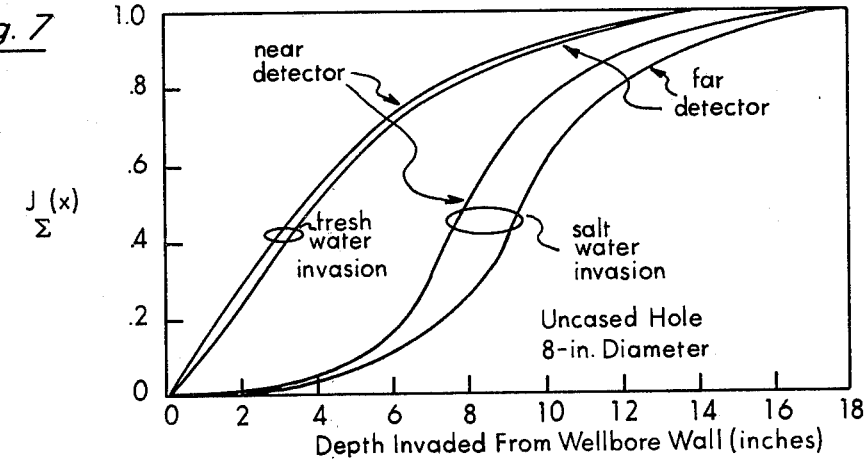
FIG. 7 is a plot of a geometric factor for a thermal neutron decay time log in an uncased wellbore.

Similarly the invasion diameter of a fluid may be determined from equations for logging instruments measuring the decay time of thermal neutrons. In this well known process, pulses of high-energy neutrons are injected into the wellbore, are slowed to thermal velocities, and then are captured by nuclei in the formation whereby gamma rays are emitted. An expression for the thermal neutron decay time log similar to those given for the resistive measurements is the following:

$$\frac{1}{\tau\{X\}} = \frac{1}{\tau_o}\{1 - J_\Sigma\{X\}\} + \frac{1}{\tau_\infty} J_\Sigma\{X\} \quad (13)$$

where $\tau_o$ equals $\tau\{_o\}$ (i.e. the measurement before the fluid has invaded the formation) and $\tau_\infty = \tau\{_\infty\}$ (i.e. the measurement when the fluid has thoroughly invaded the formation or when the fluid has invaded the formation beyond the effective measuring range of the logging tool). The J function is related to X in accordance with the well known plots shown in FIGS. 6 and 7. Thus, by taking measurements with one tool before the point of time when the fluid begins invading the formation, after the point in time when the fluid has invaded past the effective measuring range of the tool, and at two points of time therebetween, two equations in two unknowns result, and the permeability of the formation may be estimated.

Although the present invention has been described with respect to particular resistivity measuring logging instruments and a particular thermal neutron decay time measuring logging instrument, it should be understood that other instruments may be utilized to ascertain the invasion diameter at different points in time, in order to determine the relative permeability of a formation surrounding a wellbore.

The method for determining the relative permeability of an earth formation surrounding a wellbore as described above may be automated by incorporating a computer and data storage device into the apparatus of FIG. 1. As noted above, data are obtained from the elongated housing 10 containing one or more logging instruments and relayed by electrical leads within the logging cable 12 to electrical leads within electrical circuit 18 and then into a data storage device and associated computer 20 at the earth's surface. The computer is capable of performing the computations described above to automatically determine the relative permeability of an earth formation. The logging instruments are used to measure porosity ($\phi$), wellbore diameter ($D_o$) and a quantity, such as formation resistivity, which is sensitive to invasion diameter ($D_i$). Data for these quantities are relayed to the data storage device and stored as a function of wellbore depth at two or more points in time, $t_1$ and $t_2$. A log of permeability ($\kappa$) versus depth may be obtained automatically from these data by programming the computer to solve Equation (7).

The relative permeability between two earth formations such as formation A and formation B, is automatically obtained by first inputting the depth intervals encompassing the formations into the computer. The computer averages the parameters, $\phi$, $D_o$, $D_{i1}$ and $D_{i2}$, automatically over these depth intervals. The computer then calculates the permeability of formation A relative to formation B using this data array in Equation (8). The resulting computed relative permeability of the formation is made available to observers by a display means, such as a printer or a CRT, in communication with the computer.

It is important to note that the computations require sufficient time lapses between measurements so that $D_{i1}$ and $D_{i2}$ are sufficiently different to be meaningful. This may be accomplished by making repeated passes over the formations of interest and using several data pairs of time intervals to gain insight as to the uncertainty of the calculation of permeability.

While several embodiments of the present invention have been described in detail herein, various changes and modifications can be made without departing from the scope of the invention.

What is claimed is:

1. A method for determining the relative permeability of an earth formation surrounding a wellbore having a longitudinal axis comprising the steps of:

injecting a fluid into the wellbore such that the fluid invades the earth formation;

measuring at different points in time a quantity that varies in response to the radius from the wellbore axis of the fluid invasion into the earth formation;

determining in response to said quantity measurements the radius from the wellbore axis of the fluid invasion into the earth formation at different points in time; and determining in response to said radii determinations the relative permeability of the earth formation.

2. A method for determining the relative permeability of an earth formation surrounding a wellbore having a longitudinal axis according to claim 1 wherein at least one logging tool for measuring resistivity of the earth formation performs said quantity measurement.

3. A method for determining the relative permeability of an earth formation surrounding a wellbore having a longitudinal axis according to claim 1 wherein a logging tool for measuring the decay time of neutrons injected into the earth formation performs said quantity measurement.

4. A method for determining the relative permeability of an earth formation surrounding a wellbore having a longitudinal axis according to claim 3 wherein said logging tool measures the decay time at at least one point of time within each of the following four ranges of time: a first range of time before the point of time when the fluid begins invading the earth formation; a second range of time after the point of time when the fluid has invaded the earth formation beyond the effective measuring range of the logging tool; a third range of time after the first range of time and before the second range of time; and a fourth range of time after the third range of time and before the second range of time.

5. A system for determining the relative permeability of an earth formation surrounding a wellbore having a longitudinal axis comprising:

means for injecting a fluid into the wellbore such that the fluid invades the earth formation;

a first logging tool for measuring at at least one point in time a quantity that varies in response to the radius from the wellbore axis of the fluid invasion into the earth formation;

at least one other logging tool for measuring at at least one point in time a quantity that varies in response to the radius from the wellbore axis of the fluid invasion into the earth formation;

means for determining in response to said quantity measurements the radius from the wellbore axis of the fluid invasions into the earth formation at the points in time; and means for determining in response to said radii determinations the relative permeability of the earth formation.

6. A system for determining the relative permeability of an earth formation surrounding a wellbore having a longitudinal axis according to claim 5 wherein each said logging tool measures resistivity of the earth formation.

7. A system for determining the relative permeability of an earth formation surrounding a wellbore having a longitudinal axis according to claim 6 wherein there is one other said logging tool and wherein each of said two logging tools measures resistivity at the same points in time.

8. A method for determining the relative permeability of an earth formation surrounding a wellbore having a longitudinal axis comprising the steps of:

injecting a fluid into the wellbore such that the fluid invades the earth formation;

measuring with a first logging tool at at least one point in time a quantity that varies in response to the radius from the wellbore axis of the fluid invasion into the earth formation;

measuring with at least one other logging tool at at least one point in time a quantity that varies in response to the radius from the wellbore axis of the fluid invasion into the earth formation;

determining in response to said quantity measurements the radius from the wellbore axis of the fluid invasion into the earth formation at the points in time; and determining in response to said radii determinations the relative permeability of the earth formation.

9. A method for determining the relative permeability of an earth formation surrounding a wellbore having a longitudinal axis according to claim 8 wherein each logging tool measures resistivity of the earth formation.

10. A method for determining the relative permeability of an earth formation surrounding a wellbore having a longitudinal axis according to claim 9 wherein there is one other logging tool and wherein each of said two logging tools measures resistivity at the same points in time.

11. A method of calculating the relative permeability of an earth formation surrounding a wellbore having a longitudinal axis comprising the steps of:

injecting a fluid into the wellbore such that the fluid invades the earth formation;

determining at different points in time the diameter of fluid invasion into the earth's formation from the wellbore axis at a first point along the wellbore;

determining the porosity of the earth formation surrounding the wellbore at said first point;

determining the wellbore diameter at said first point;

determining substantially at said different points in time the diameter of fluid invasion into the earth's formation from the wellbore axis at a second point along the wellbore;

determining the porosity of the earth formation surrounding the wellbore at said second point;

determining the wellbore diameter at said second point; and calculating the relative permeability of the earth formations surrounding the wellbore at said first and second points according to the equation:

$$\frac{K_A}{K_B} = \frac{\phi_A}{D_{OA}} \frac{D_{OB}}{\phi_B} \frac{D_{i2A}^2 - D_{i1A}^2}{D_{i2B}^2 - D_{i1B}^2}$$

where $K_A$ is the permeability of the earth formation surrounding the wellbore at said first point, where $K_B$ is the permeability of the earth formation surrounding the wellbore at said second point, where $\phi_A$ is the porosity of the earth formation surrounding the wellbore at said first point, where $\phi_B$ is the porosity of the earth formation surrounding the wellbore at said second point, where $D_{OA}$ is the wellbore diameter at said first point, where $D_{OB}$ is the wellbore diameter at said second point, where $D_{i1A}$ is the diameter of fluid invasion at a first time at said first point, where $D_{i2A}$ is the diameter of fluid invasion at said second time at said first point, where $D_{i1B}$ is the diameter of fluid invasion substantially at said first time at said second point, and where $D_{i2B}$ is the diameter of fluid invasion substantially at said second time at said second point.

12. A method of calculating the relative permeability of an earth formation surrounding a wellbore having a longitudinal axis according to claim 11 wherein said diameters of fluid invasion are determined with the aid of a logging tool for measuring resistivity of an earth formation.

13. A method of calculating the relative permeability of an earth formation surrounding a wellbore having a longitudinal axis according to claim 11 wherein said diameters of fluid invasion are determined with the aid of a logging tool for measuring the decay time of neutrons injected into the earth formation.

* * * * *

UNITED STATES PATENT AND TRADEMARK OFFICE

CERTIFICATE OF CORRECTION

PATENT NO. : 4,420,975

DATED : December 20, 1983

INVENTOR(S) : Walter A. Nagel et al

It is certified that error appears in the above-identified patent and that said Letters Patent are hereby corrected as shown below:

Title page: Under References Cited, delete "2,463,230" and insert --3,463,230-- and on same line delete "1949" and insert --1969--.

Signed and Sealed this

*Third* Day of *April 1984*

[SEAL]

*Attest:*

GERALD J. MOSSINGHOFF

*Attesting Officer*

*Commissioner of Patents and Trademarks*